US005510185A

United States Patent [19]

Fujisawa et al.

[11] Patent Number: 5,510,185

[45] Date of Patent: Apr. 23, 1996

[54] CARBON FIBER CHOPPED STRANDS AND COATING DISPERSION USED FOR PRODUCING SAME

[75] Inventors: Eiji Fujisawa; Hiroaki Shono, both of Fukushima; Kozo Yudate, Chiba; Ichiro Fujishima, Tokyo, all of Japan

[73] Assignee: Nitto Boseki Co., Ltd., Fukushima, Japan

[21] Appl. No.: 361,151

[22] Filed: Dec. 21, 1994

Related U.S. Application Data

[63] Continuation of Ser. No. 918,069, Jul. 24, 1992, abandoned.

[30] Foreign Application Priority Data

Jul. 26, 1991 [JP] Japan ..... 3-187290

[51] Int. Cl.[6] ..... B32B 9/00

[52] U.S. Cl. ..... 428/368; 428/364; 428/367; 423/368; 423/439; 423/447.1; 423/448

[58] Field of Search ..... 428/368, 364, 428/367, 373; 423/447, 447.2, 439, 448, 368

[56] References Cited

U.S. PATENT DOCUMENTS

| | | | |
|---|---|---|---|
| 3,869,302 | 3/1975 | Shea et al. | 117/46 |
| 4,016,247 | 4/1977 | Otani et al. . | |
| 4,064,207 | 12/1977 | DeCrescente et al. . | |
| 4,312,742 | 1/1982 | Hayashi . | |
| 4,472,265 | 9/1984 | Otani . | |
| 4,933,314 | 6/1990 | Marumo et al. | 502/416 |
| 5,030,282 | 7/1991 | Matsuhashi et al. . | |
| 5,030,435 | 7/1991 | Kitamura et al. | 423/447 |

FOREIGN PATENT DOCUMENTS

| | | |
|---|---|---|
| 22975 | 1/1990 | Japan . |
| 333221 | 2/1991 | Japan . |

*Primary Examiner*—Patrick J. Ryan
*Assistant Examiner*—Merrick Dixon
*Attorney, Agent, or Firm*—Foley & Lardner

[57] ABSTRACT

The invention is directed to chopped strands of carbon fibers in which 0.3–5% by weight of carbonaceous spherules are present between filaments of carbon fibers. The chopped strands of carbon fibers can be used in spinning. During production, the chopped strands include water, or an organic medium, in which 1–15% by weight of carbonaceous spherules are dispersed. The chopped strands of carbon fibers show no fusion of filaments together, are excellent in separationability and easily disperse in a matrix while maintaining excellent bundling properties.

4 Claims, No Drawings

CARBON FIBER CHOPPED STRANDS AND COATING DISPERSION USED FOR PRODUCING SAME

This is a file wrapper continuation application of U.S. Ser. No. 07/918,069, now abandoned.

BACKGROUND OF THE INVENTION

The present invention relates to carbon fiber chopped strands and a coating dispersion used in spinning for production of the chopped strands. More particularly, it relates to carbon fiber chopped strands excellent in separating (unbinding) for the purpose of improving dispersibility in a matrix when used as reinforcements for composite materials and a coating dispersion used for production of the strands.

At present, carbon fibers are widely used in various fields. From the viewpoint of starting materials, carbon fibers can be roughly classified into polyacrylonitrile based carbon fibers, rayon based carbon fibers and pitch based carbon fibers. The production cost of the pitch based carbon fibers produced from carbonaceous pitches such as petroleum pitch and coal tar pitch is lower than that of polyacrylonitrile or rayon based carbon fibers because the starting materials for the former are inexpensive as compared with the starting materials for the latter and besides, yield of carbonization is higher in production of pitch based carbon fibers. Thus, pitch based carbon fibers have recently been noticed and many researches have been made thereon.

Carbon fibers are produced, for example, by the following process.

(1) A carbonaceous pitch suitable for production of carbon fibers is prepared from petroleum or coal tar pitches, the resulting carbonaceous pitch is molten by heating and spun into filaments and the resulting filaments are bundled to make a pitch fiber strand.

(2) The pitch fiber strand is infusiblized by heating in an oxidizing gas atmosphere. This step is a step of oxidizing the thermoplastic pitch fibers to convert them into infusiblized fibers which are no longer molten even by heating.

(3) Subsequently, the infusiblized fibers are carbonized or graphitized at a high temperature in an inert atmosphere. By this treatment, volatile component in the infusiblized fibers and thermally unstable portion in the pitch molecules are decomposed and volatilized and the aromatic structure in the molecules is developed into a structure of high carbon content and in some case a structure close to graphite structure. As a result, carbon fibers of high strength and high elasticity are obtained.

This process suffers from the problem that the fibers which constitute the pitch fiber strand fuse together at the time of infusiblization of the bundled pitch fiber strand and various proposals have been made in an attempt to solve this problem. For example, Japanese Patent Kokoku No. Hei 2-2975 has proposed a process for infusiblization by allowing molybdenum disulfide to adhere to the pitch fibers. Furthermore, Japanese Patent Kokai No. Hei 3-33221 has proposed a process for infusiblization by allowing graphite to adhere to the pitch fibers. Japanese Patent Kokoku No. Hei 2-2975 proposed a process which comprises allowing graphite to adhere to the pitch fibers, chopping the pitch fibers and infusiblizing the pitch fibers in the form of chopped strand.

Pitch based carbon fibers are often produced in the form of chopped strands and used in that form. That is, they are produced by bundling carbon fibers and cutting them to short fibers and these are used as reinforcements for matrices such as thermoplastic resins, cements, ceramics and metals by dispersing them in the matrices as filaments of carbon fibers.

The chopped strands must maintain the bundled state before use for easy handling, good transportability and inhibition of fluffing. On the other hand, the chopped strands must be able to be completely and easily dispersed in a matrix as filaments in use.

There are various methods for dispersing the carbon fiber chopped strands in the matrix, but are subject to restriction by the kind of the matrix and molding method of the matrix. The carbon fiber chopped strands produced by the conventional processes have the problem that they can be satisfactorily dispersed by mixers such as an extruder which give strong shearing force, but are difficult to disperse by mixers such as omnimixer which give weak shearing force. Therefore, such carbon fiber chopped strands have been desired which are excellent in dispersibility of carbon fibers, namely, in separating (unbinding) of the strands.

SUMMARY OF THE INVENTION

The first object of the present invention is to provide carbon fiber chopped strands which maintain strongly bundled state, are free from fusing of filaments to each other and have excellent dispersibility and separating (unbinding).

The second object of the present invention is to provide a coating agent which is applied to spun pitch fibers and is suitable for producing the above-mentioned carbon fiber chopped strands.

As a result of intensive research conducted by the inventors for attaining the above objects, it has been found that chopped strands excellent in dispersibility and separating can be obtained by allowing carbonaceous spherules to be present between filaments of carbon fibers which constitute carbon fiber chopped strands. Thus, the present invention has been accomplished.

That is, the present invention resides in carbon fiber chopped strands, characterized in that carbonaceous spherules are present in an amount of 0.3–5% by weight between filaments of carbon fibers.

Furthermore, the present invention resides in a coating dispersion used for production of the carbon fiber chopped strands which is applied to pitch fibers upon spinning and which is prepared by dispersing 1–15% by weight of carbon spherules in water or an organic medium.

DESCRIPTION OF THE INVENTION

The present invention will be explained in detail.

The carbon fiber chopped strands of the present invention are produced from petroleum pitch or coal tar pitch as a starting material. Either isotropic or mesophase pitch can be used.

Pitch fibers which are melt spun from nozzles having 30–4000 holes are applied with the coating dispersion of the present invention and bundled. The coating dispersion of the present invention which is applied to the spun pitch fibers is a dispersion of 1–15% by weight of carbonaceous spherules in water or an organic medium.

As used herein, the term "carbonaceous spherules" mean spherical particles containing at least 85% by weight of carbon. It is a matter of course that the carbonaceous spherules may be those which comprise pure carbon of 100% in carbon content. Particle diameter has no special limitation, but the carbonaceous spherules having a diameter smaller than that of the pitch fibers are effective to develop the advantageous effect of the present invention. The carbonaceous spherules can be produced, for example, by heat treating high carbon residue organic materials such as spherical phenolformaldehyde resin, furan resin and mesophase pitch in an inert gas at 450° C. or higher, preferably 600° C. or higher for 60 minutes or more. The high carbon residue organic material is an organic material containing a carbonaceous component in an amount of at least 30% based on the initial weight of the organic material which remains upon being heated to 1000° C. at a heating rate of 5° C./min in an inert gas.

As the dispersion medium for the carbonaceous spherules, there may be used any of water or organic media such as methanol, ethanol, acetone and silicone oils. For dispersing the carbonaceous spherules in the above media, it is more effective to add a slight amount of an anionic or nonionic surface active agent.

The concentration of the carbonaceous spherules in the medium is 1–15% by weight. If it is less than 1%, the fibers partially contact with each other owing to the small amount of the carbonaceous spherules which adhere to the pitch fibers and this is not preferable. Even if it is increased to more than 15%, the dispersibility no longer increases.

Other fillers such as graphite, molybdenum disulfide and talc besides the carbonaceous spherules can also be added to the coating dispersion used in spinning in the present invention.

There is no special limitation in the method of allowing the carbonaceous spherules to adhere to the pitch fibers, but suitable are coating by apron roll, spraying, etc. The applied carbonaceous spherules are adsorbed onto the surface of the filaments of the pitch fibers and thus, the carbonaceous spherules are present between the filaments which constitute the bundled strands. Amount of the coating dispersion which adheres to the pitch fibers is 20–50% by weight.

The pitch fibers applied with the coating dispersion are bundled by a bundling roller or the like and the bundled pitch fibers are cut to a length of 1–50 mm to make chopped strands. Then, the thus obtained chopped strands are infusiblized and carbonized. The infusiblization and the carbonization can be carried out by known methods. In the case of isotropic pitch fibers, the infusiblization is carried out, for example, by heating the strands at a rate of 0.5°–1.5° C./min and keeping the strands at 320° C. for 0–15 minutes in an oxidizing atmosphere. In the case of mesophase pitch fibers, the infusiblization is carried out, for example, by heating the strands at a rate of 2°–10° C./min and keeping them at 320° C. for 0–15 minutes. The carbonization is carried out, for example, by heating the strands at a heating rate of 5°–100° C./min and keeping them at 800°– 3000° C. for 0–30 minutes in an inert atmosphere.

Thus, the carbonaceous spherules which have been applied in spinning and subjected to the above heat treatment are present between the filaments which constitute the carbon fiber chopped strands produced as mentioned above. The carbonaceous spherules are spherules containing 90% or more of carbon and particle diameter thereof is not critical, but is preferably smaller than the diameter of the filaments of the carbon fibers for bringing out the advantageous effect of the present invention. The amount of the carbonaceous spherules which adhere to the carbon fibers is preferably 0.3–5.0% by weight. If it is less than 0.3%, sufficient effect cannot be obtained and even if it is increased to more than 5.0%, the higher effect cannot be obtained.

As explained above, by applying a coating dispersion containing carbonaceous spherules to the spun pitch fibers, the carbonaceous spherules are present between the filaments of the pitch fibers and effectively inhibit contact of the filaments with each other which constitute the strands and fusion or agglutination of the filaments with each other during infusiblization and carbonization.

Therefore, deterioration of the filaments due to fusion of the filaments can be inhibited. Furthermore, the carbonaceous spherules are present between the filaments of the carbonized chopped strands, but since they are in the spherical form, contact area between the spherules and the carbon fibers is minimum and can be easily dispersed in a matrix even under weak shearing force.

The present invention will be explained in more detail by the following nonlimiting examples, in which % is by weight.

EXAMPLE 1

Spherical phenol-formaldehyde resin (Unibex manufactured by Unitika Ltd.; average particle diameter: 10 μ) was heat treated at 600° C. for 1 hour in an inert atmosphere to obtain carbonaceous spherules having a carbon content of 90% and an average particle diameter of 7 μ.

To 10 parts by weight of the resulting carbonaceous spherules was added 0.1 part by weight of an anionic surface active agent (Demol AS manufactured by Kao Co., Ltd.) and then the mixture was dispersed in 90 parts by weight of water to obtain a coating dispersion.

EXAMPLE 2

To 1 part by weight of the carbonaceous spherules prepared in Example 1 was added 0.01 part by weight of the anionic surface active agent used in Example 1 and the mixture was dispersed in 99 parts by weight of water to obtain a coating dispersion.

EXAMPLE 3

To 1 part by weight of the carbonaceous spherules prepared in Example 1 and 2 parts by weight of platy graphite (manufactured by Japan Graphite Co., Ltd., average particle diameter: 2μ) was added 0.03 part by weight of the anionic surface active agent used in Example 1 and the mixture was dispersed in 99 parts by weight of water to obtain a coating dispersion.

EXAMPLE 4

An optically isotropic precursor pitch having a softening point of 210° C. was melt spun (diameter of the resulting fiber: 14μ) by nozzles having 1000 holes at 300° C. and the filaments were coated with the coating dispersion of Example 1 by apron rollers and bundled by gathering rollers. The bundled strand was cut to a length of 3 mm to make chopped strands. Then, the chopped strands were heated to 300° C. and kept at that temperature for 5 minutes to infusiblize them and subsequently, kept at 1000° C. for 10 minutes in a nitrogen atmosphere to carbonize them and thus, carbon fiber chopped strands were obtained. Amount of the carbonaceous spherules which adhered to the carbon fibers was 3.2%.

EXAMPLE 5

Carbon fiber chopped strands were obtained in the same manner as in Example 4 except that the coating dispersion of Example 2 was used in place of that of Example 1. Amount of the carbonaceous spherules which adhered to the carbon fibers was 0.3%.

EXAMPLE 6

Carbon fiber chopped strands were obtained in the same manner as in Example 4 except that the coating dispersion of Example 3 was used in place of that of Example 1. Total amount of the carbonaceous spherules and the platy graphite which adhered to the carbon fibers was 0.9%.

Comparative Example 1

Ten parts by weight of a spherical phenolformaldehyde resin (Unix manufactured by Unitika Ltd.; average particle diameter: 10μ) was dispersed in 90 parts by weight of water to obtain a coating dispersion.

Then, carbon fiber chopped strands were obtained in the same manner as in Example 4 except that the above coating dispersion was used in place of the coating dispersion of Example 1. Amount of the resin which adhered to the carbon fibers was 3.5%.

Comparative Example 2

To 10 parts by weight of platy graphite (Special CP manufactured by Japan Graphite Co., Ltd.; average diameter: 7μ) was added 0.1 part by weight of the anionic surface active agent used in Example 1 and the mixture was dispersed in 90 parts by weight of water to obtain a coating dispersion.

Then, carbon fiber chopped strands were obtained in the same manner as in Example 4 except that the above coating dispersion was used in place of the coating dispersion of Example 1. Amount of the resin which adhered to the carbon fibers was 3.1%.

Comparative Example 3

To 10 parts by weight of platy graphite (USSP manufactured by Japan Graphite Co., Ltd.; average diameter: 2μ) was added 0.1 part by weight of the anionic surface active agent used in Example 1 and the mixture was dispersed in 90 parts by weight of water to obtain a coating dispersion.

Then, carbon fiber chopped strands were obtained in the same manner as in Example 4 except that the above coating dispersion was used in place of the coating dispersion of Example 1. Amount of the resin which adhered to the carbon fibers was 2.9%.

Evaluation of properties:

Separation and infusiblizability of the carbon fiber chopped strands produced in Examples 4–6 and Comparative Examples 1–3 and tensile strength and tensile modulus of elasticity of separated carbon fiber monofilaments were evaluated by the following methods. Carbon fiber chopped strands of 50 mm in length was used for measurement of tensile strength and tensile modulus of elasticity of carbon fiber monofilaments.

Separation:

0.25 Gram of carbon fiber chopped strands of 3 mm in length were dipped in 300 ml of water and stirred by a homomixer at 5000 rpm for 45 seconds to disperse them and then the dispersion was subjected to suction filtration. The number of gathered chopped strands was counted and separation was evaluated by the following criteria.

| The number of gathered chopped strands | Evaluation |
|---|---|
| 10 or more | x |
| 5–9 | Δ |
| 2–4 | ○ |
| 1 or less | ⊙ |

Infusiblizability:

Whether the filaments which constitute the chopped strands fused together or not was visually examined. Furthermore, a chopped strand was hold between two fingers and applied with a light force thereby and it was observed whether the strand was separated (unbound) or not.

| | |
|---|---|
| Filaments of the strand did not fuse together and the strand was easily separated. | ○ |
| The filaments did not apparently fuse together, but the strand was hard and difficult to separate. | Δ |
| The filaments fused together and the strand could be hardly separated. | x |

Tensile strength of carbon fiber monofilament was measured in accordance with JIS R7601.

Tensile modulus of elasticity of carbon fiber monofilament was measured in accordance with JIS R7601.

The test results are shown in Table 1.

TABLE 1

| | Filler | | Chopped strand | | Monofilaments of carbon fibers | |
|---|---|---|---|---|---|---|
| | Kind | Adhering amount wt. (%) | Separation | Infusi-blization | Tensile strength (kg/mm²) | Tensile modulus of elasticity |
| Example 4 | Carbona-ceous spherules | 3.2 | ⊙ | ○ | 100 | 4.2 |
| Example 5 | Carbona-ceous spherules | 0.3 | ○ | ○ | 97 | 4.3 |
| Example 6 | Carbona-ceous | 0.9 | ○ | ○ | 98 | 4.2 |

TABLE 1-continued

| | Filler | | Chopped strand | | Monofilaments of carbon fibers | |
|---|---|---|---|---|---|---|
| | Kind | Adhering amount wt. (%) | Separation | Infusi-blization | Tensile strength (kg/mm$^2$) | Tensile modulus of elasticity |
| | spherules Platy graphite | | | | | |
| Comparative Example 1 | Spherical phenol-form-aldehyde resin | 3.5 | x | x | Unmeas-urable | Unmeas-urable |
| Comparative Example 2 | Platy graphite | 3.1 | Δ | Δ | 75 | 3.7 |
| Comparative Example 3 | Platy graphite | 2.9 | Δ | ○ | 85 | 3.8 |

As explained above, the carbon fiber chopped strands of the present invention show no fusion of filaments to each other, are excellent in separating and easily disperse in a matrix with maintaining excellent bundling property. Therefore, not only the use as reinforcements for composite materials is expanded, but also it can be expected that effects as reinforcements are sufficiently exhibited. Furthermore, since carbonaceous spherules are present in the carbon fibers of the present invention, the fibers do not contact with each other and the carbon fibers are not deteriorated and thus, carbon fibers of high strength can be stably obtained.

What is claimed is:

1. A chopped strand of carbon fibers comprising carbon fibers and 0.3–5% by weight of carbonaceous spherule particles adsorbed onto the surface of the carbon fibers.

2. A chopped strand of carbon fibers according to claim 1, wherein the carbon fibers are those which are made from a pitch.

3. A chopped strand of carbon fibers according to claim 2, wherein the pitch is an isotropic pitch or a mesophase pitch.

4. A chopped strand of carbon fibers according to claim 1, wherein the carbonaceous spherules contain at least 85% by weight of carbon.

* * * * *